US010648226B2

(12) United States Patent
Borgelt et al.

(10) Patent No.: US 10,648,226 B2
(45) Date of Patent: May 12, 2020

(54) MAIN-FRAME BAR AND/OR WING-FRAME BAR, AND DOOR, WINDOW, OR FAçADE ELEMENT

(71) Applicant: SCHÜCO INTERNATIONAL KG, Bielefeld (DE)

(72) Inventors: Florian Borgelt, Halle (DE); André Porombka, Bielefeld (DE); Nikolaus Strassheim, Bielefeld (DE); Matthias Brandes, Vlotho (DE); Carsten Siekmann, Hiddenhausen (DE)

(73) Assignee: SCHÜCO INTERNATIONAL KG, Bielefeld (DE)

( * ) Notice: Subject to any disclaimer, the term of this patent is extended or adjusted under 35 U.S.C. 154(b) by 0 days.

(21) Appl. No.: 16/080,402

(22) PCT Filed: Feb. 24, 2017

(86) PCT No.: PCT/EP2017/054352
§ 371 (c)(1),
(2) Date: Aug. 28, 2018

(87) PCT Pub. No.: WO2017/148820
PCT Pub. Date: Sep. 8, 2017

(65) Prior Publication Data

US 2019/0178026 A1 Jun. 13, 2019

(30) Foreign Application Priority Data

Feb. 29, 2016 (DE) ..... 10 2016 103 590
Nov. 4, 2016 (DE) ..... 10 2016 121 059

(51) Int. Cl.
*E06B 5/16* (2006.01)
*E06B 3/263* (2006.01)
*E06B 3/70* (2006.01)

(52) U.S. Cl.
CPC ..... *E06B 5/161* (2013.01); *E06B 5/168* (2013.01); *E06B 2003/2639* (2013.01); *E06B 2003/7046* (2013.01)

(58) Field of Classification Search
CPC .. E06B 5/161; E06B 5/168; E06B 2003/2639; E06B 2003/7046
See application file for complete search history.

(56) References Cited

U.S. PATENT DOCUMENTS 5,694,731 A 12/1997 Tönsmann et al.
6,141,923 A 11/2000 Habicht et al.
(Continued)

FOREIGN PATENT DOCUMENTS

DE 4443762 A1 6/1996
DE 19700696 B4 7/2008
(Continued)

OTHER PUBLICATIONS

Deutsche Norm, "Doors; smoke control doors; definitions and requirements," DIN 18 095-1, Oct. 1988.
(Continued)

*Primary Examiner* — Paola Agudelo
(74) *Attorney, Agent, or Firm* — Patent Portfolio Builders PLLC

(57) ABSTRACT

A main-frame bar and/or to a wing-frame bar for a main frame and/or a wing frame of a window, of a door, or of a façade element includes a main profiled element having a substantially U-shaped cross-section in single- or multi-piece design, which has, as viewed in a cross-section, a short leg, a long leg, and a transverse leg formed therebetween. A free intermediate space is formed between the ends of the short leg and of the long leg facing away from the transverse leg, a cover element and/or a fitting part extending over the intermediate space at least in some sections. The short leg
(Continued)

and the long leg of the main profiled element have multi-function contours on the inner sides thereof facing each other, which multi-function contours completely or partially bound at least the following groove: in each case, a fastening groove open in the same direction on the side facing away from the transverse leg for fastening a corresponding fastening means of the fitting part or of the cover element.

27 Claims, 16 Drawing Sheets

(56) References Cited

U.S. PATENT DOCUMENTS

| | | | | |
|---|---|---|---|---|
| D597,220 | S * | 7/2009 | Campbell | D25/124 |
| 7,987,633 | B2 * | 8/2011 | Lenox | E06B 3/26303 49/504 |
| 8,176,709 | B2 * | 5/2012 | Siodla | E06B 3/26303 49/1 |
| 9,115,520 | B2 * | 8/2015 | Eyme | E05D 15/066 |
| 9,388,627 | B2 * | 7/2016 | Rawlings | E06B 3/26303 |
| 9,920,568 | B2 * | 3/2018 | Rethmeier | E06B 3/26303 |
| 2002/0046539 | A1 * | 4/2002 | Schulz | E06B 3/2632 52/843 |
| 2005/0115193 | A1 * | 6/2005 | Brunnhofer | E06B 3/2632 52/717.02 |
| 2008/0178552 | A1 * | 7/2008 | Dampierre | E06B 3/273 52/656.2 |
| 2009/0031665 | A1 * | 2/2009 | Esen | E06B 1/32 52/656.2 |

FOREIGN PATENT DOCUMENTS

| | | | |
|---|---|---|---|
| EP | 1327739 | A2 | 7/2003 |
| EP | 1138864 | B1 | 9/2004 |
| EP | 2116685 | A2 | 11/2009 |

OTHER PUBLICATIONS

Deutsche Norm, "Fire behaviour of building materials and components; fire barriers—concepts, requirements and testing," DIN 4102-5, Sep. 1989.

International Search Report dated May 26, 2017 in related International Application No. PCT/EP2017/054352.

Written Opinion dated May 26, 2017 in related International Application No. PCT/EP2017/054352.

* cited by examiner

Fig. 2b)
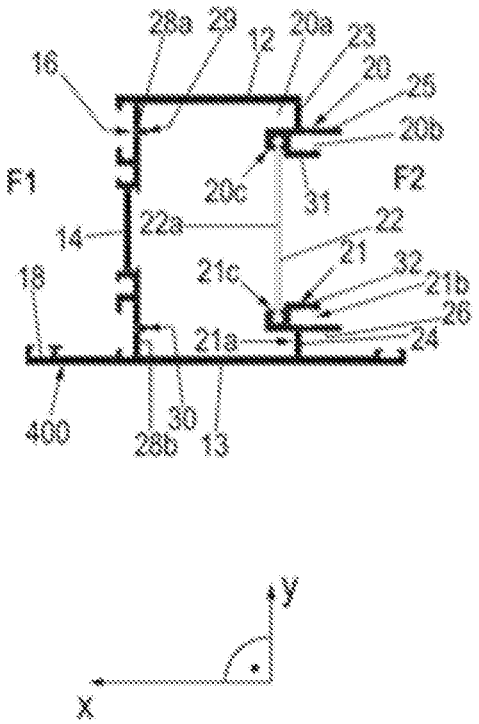
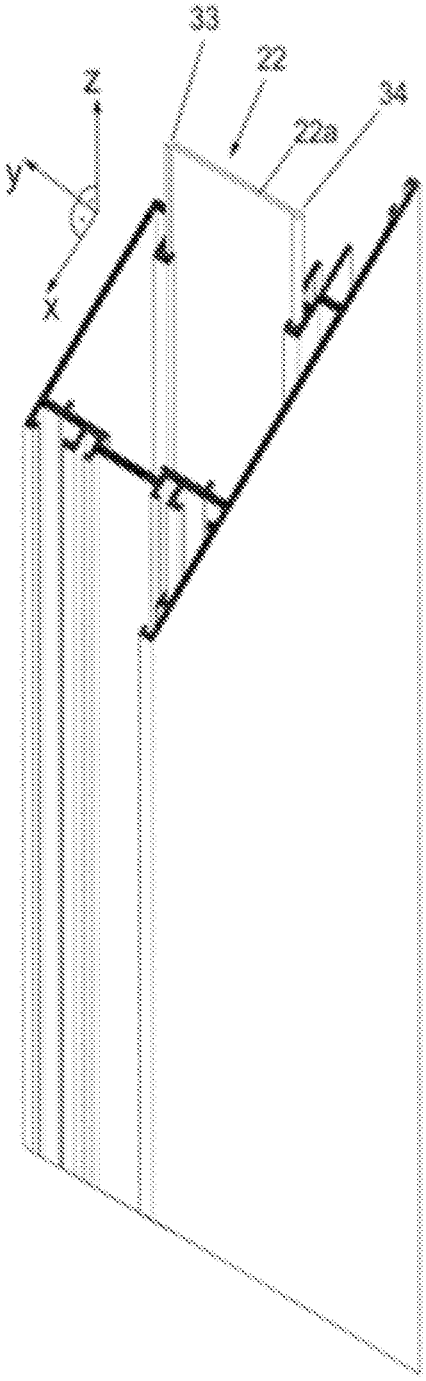
Fig. 2c)

F3

MAIN-FRAME BAR AND/OR WING-FRAME BAR, AND DOOR, WINDOW, OR FAçADE ELEMENT

BACKGROUND AND SUMMARY OF THE INVENTION

Exemplary embodiments of the present invention relate to a frame spar and/or sash spar for a frame and/or a sash of a window, a door or a façade element, and a door, a window, a façade element comprising a frame and a sash made of such frame spars or sash spars, respectively.

Smoke protection doors (RS) according to DIN 18095 are self-closing doors which substantially prevent the passage of smoke in the installed and closed state. A fire protection closure alternatively or additionally has the object of securing openings in walls against the passage of fire. According to DIN 4102-5, there are the following fire protection classes: T30, T60, T90, T120, and T180. The number after the T indicates the duration in minutes, for which duration the fire protection closure prevents the passage of the fire (not of the smoke) and still has to be able to be opened.

The production and manufacturing of known designs meeting these requirements are relatively complex.

Exemplary embodiments of the present invention are directed to a frame spar and/or sash spar for a frame and sash, respectively, of a window, a door, or a façade element, which are each preferably well suitable for a use as a frame spar of a frame and a sash of a smoke protection door or a fire protection door at least according to fire protection class T30 and are to be manufactured easily and precisely to form such a door (or a corresponding window or façade element, respectively).

A frame spar and/or a sash spar are respectively provided for a frame and/or a sash of a window, a door, or a façade element, which respectively have at least the following features:

- a main profile having a substantially U-shaped cross section in one piece or multipiece design, which, viewed in cross section, has a short leg and a long leg and a transverse leg formed between them,
- wherein an intermediate space, which is overlapped at least in sections by a fitting part and/or a cover element, is formed between the end regions of the short leg and the long leg facing away from the transverse leg,
- wherein both the short leg and the long leg of the main profile each have, on the inner sides thereof facing toward one another, multifunction contours, which entirely or partially delimit at least the following groove:
- respectively a fastening groove open on the side facing away from the transverse leg for fixing a corresponding fastening means of the fitting part and/or the cover element to overlap the intermediate space between the long leg and the short leg.

The two fastening means on the cover element or elements and/or on the fitting part or parts are each insertable perpendicularly to the transverse leg and parallel to the short leg and the long leg, in order to be fixed in the fastening grooves.

The fastening groove particularly preferably has at least one catch means for locking fixing of at least one corresponding counter catch means of the fitting part and/or the cover element.

According to one particularly preferred embodiment, the at least one cover element is a cover profile which forms a visual rabbet screen. This cover profile is clipped perpendicularly to the transverse leg into the fastening grooves, and therefore it is fixed therein. In this case, the catch connection on the cover profile preferably has enough play according to one variant that a clamping and therefore shear-resistant connection is not formed between the cover profile and the main profile, but rather the cover profile may be manually displaced without tools on the main profile. The cover profile then does not assume a static function—except in case of fire—and does not or does not noticeably stabilize the main profile. It is merely used to cover the gap/free space between the long leg and the short leg on the side thereof facing away from the main leg or transverse leg. The cover profile is preferably longer than 10 cm. It can cover the entire free space/gap between the short leg and the long leg over the complete length and is preferably solely not placed in the region of locks and fitting parts. Of course, a plurality of the cover profiles can also be provided. The sash and the frame are preferably provided with the cover profiles on multiple or even all parts.

Since the cover profile or profiles preferably do not assume a static function, they can simply be clipped onto the main profile perpendicularly to the transverse leg. For this purpose, it is in turn advantageous if the cover profiles are themselves U-shaped. In case of fire, it is advantageous if the cover profile or profiles consist entirely or partially of a foaming material.

BRIEF DESCRIPTION OF THE DRAWING FIGURES

Exemplary embodiments of the invention are illustrated in the drawings and will be described in greater detail hereafter. In the figures.

Figure 3A:
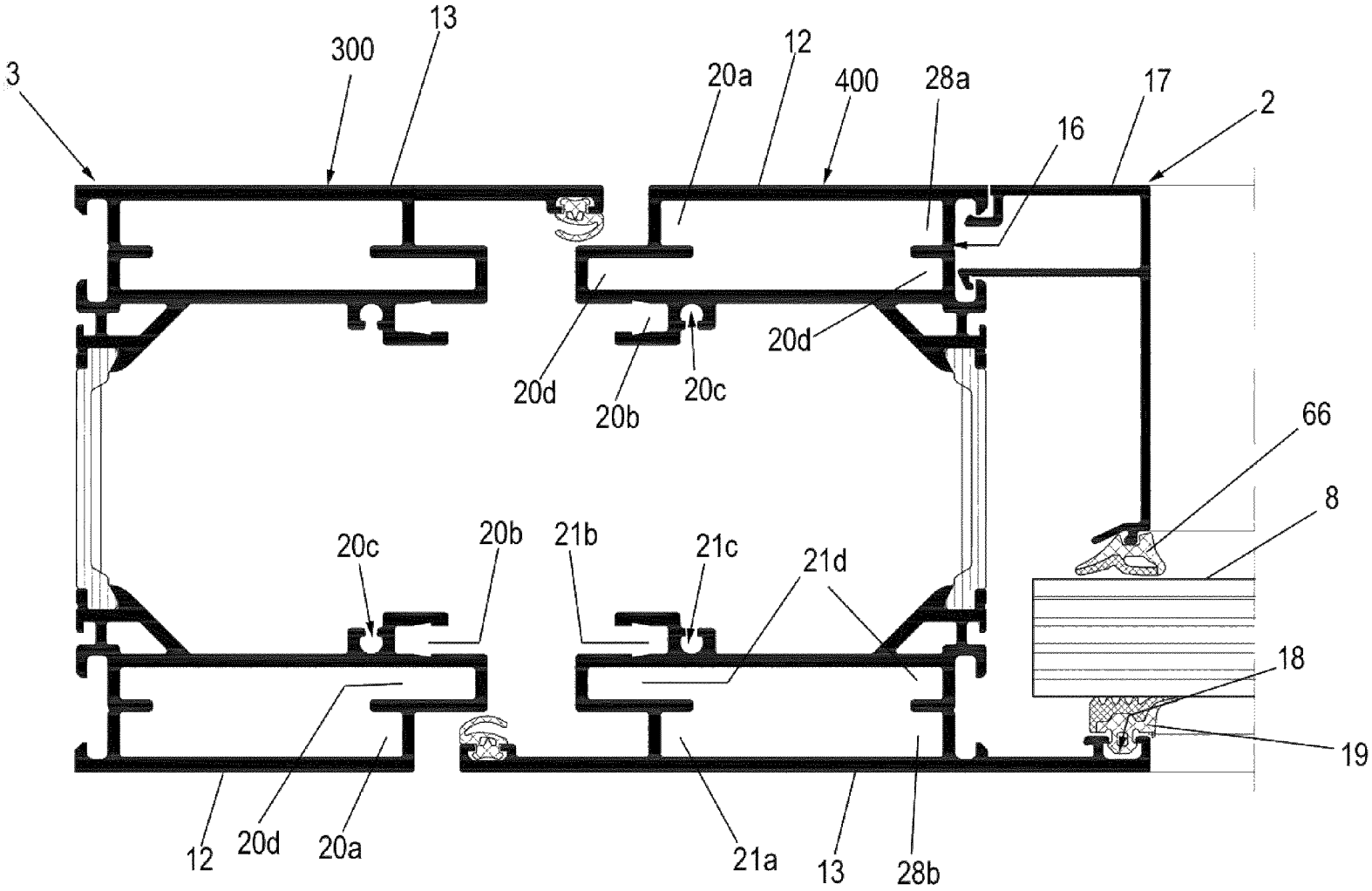
Figure 3:
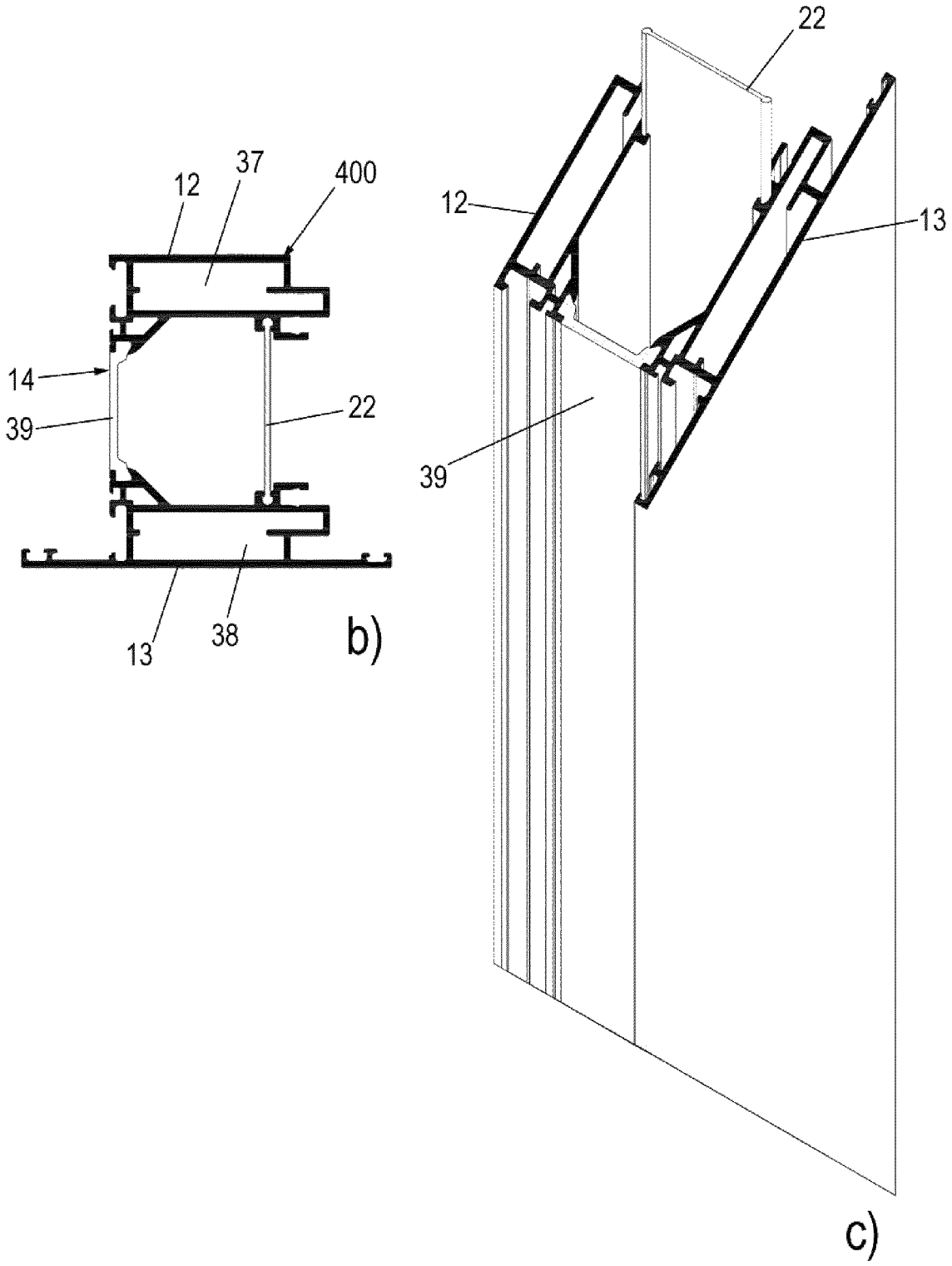
Figure 4:
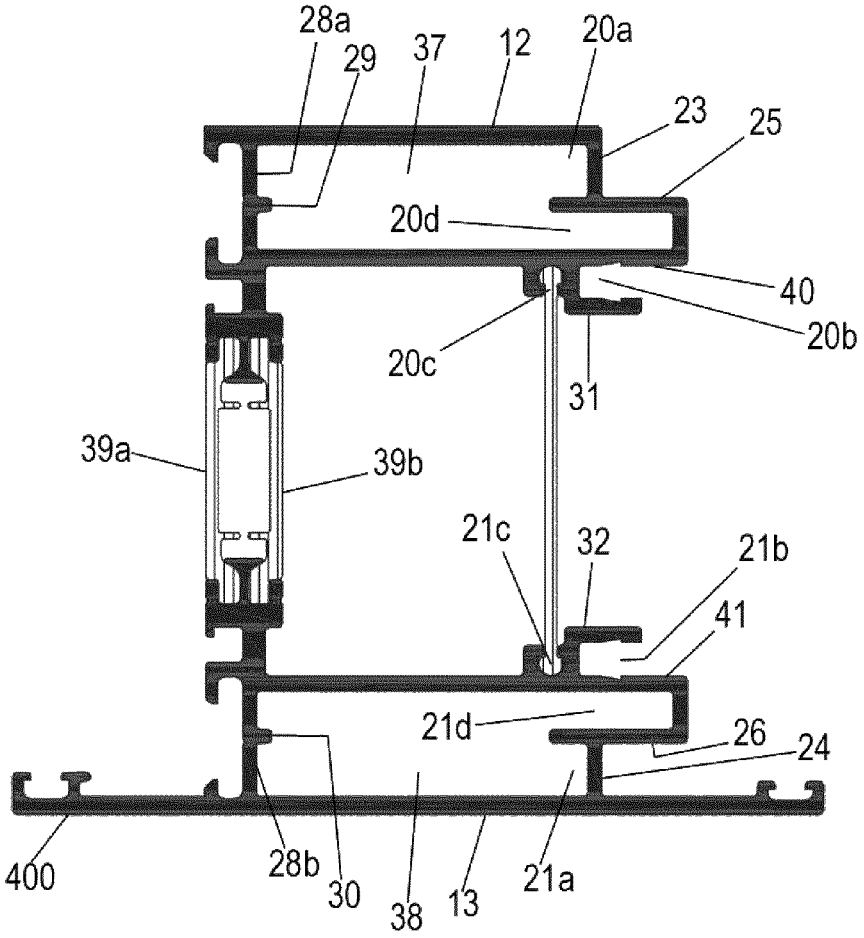
Figure 5:
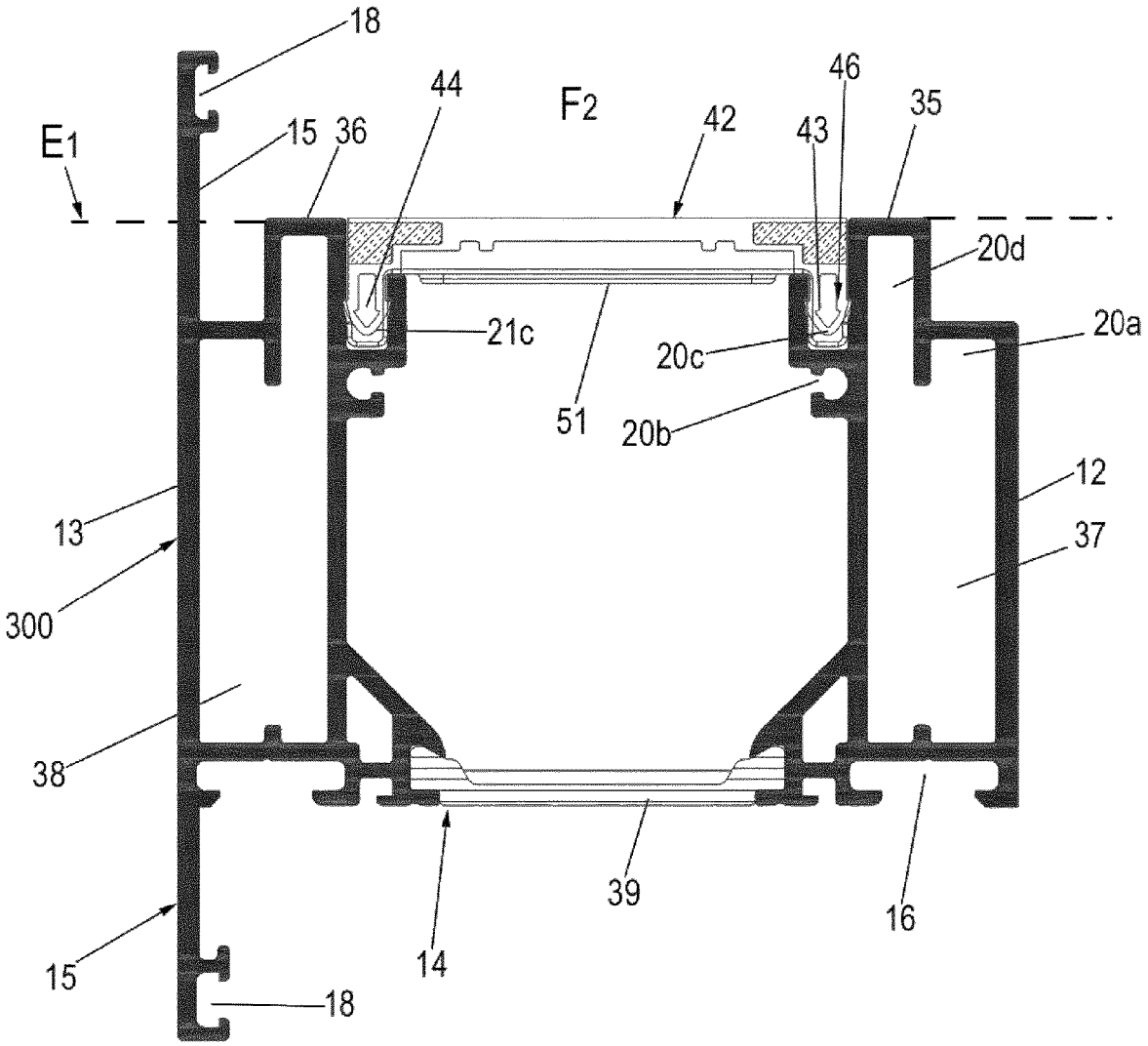
Figure 7A:
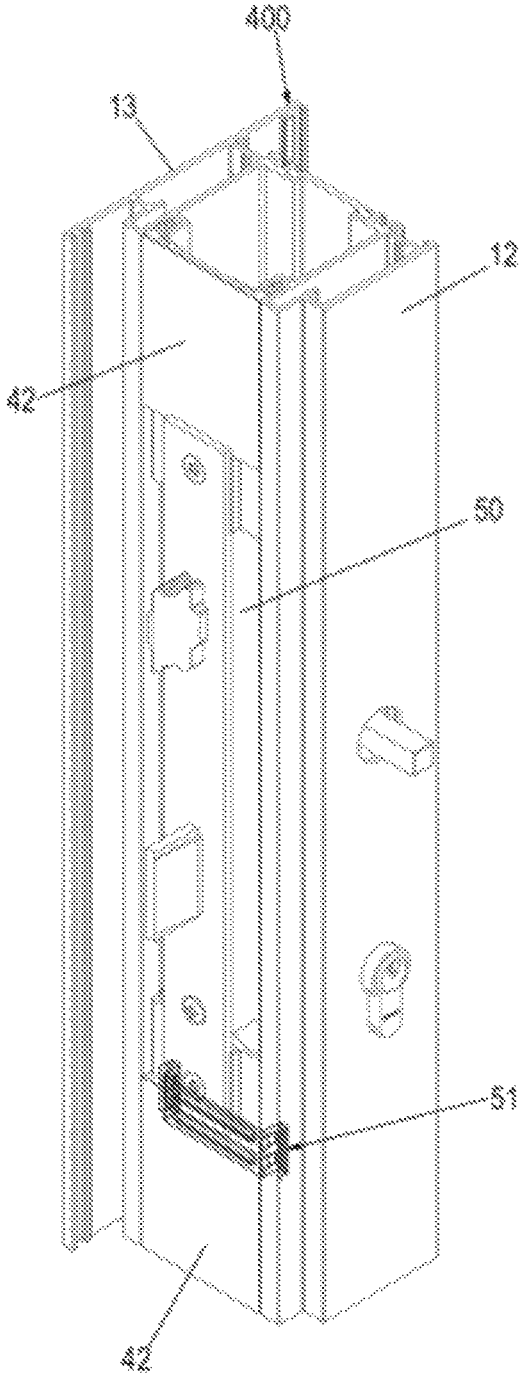
Figure 7B:
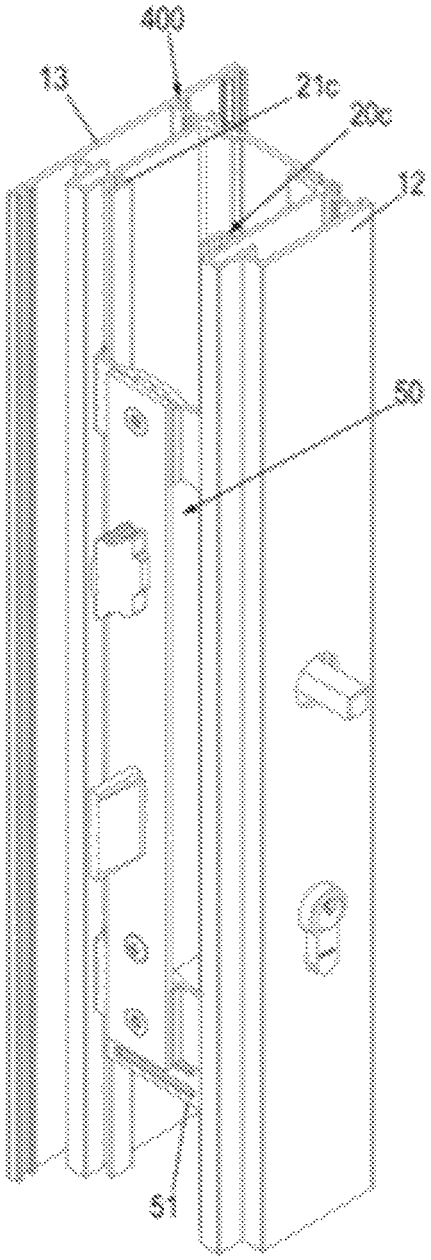
Figure 8B:
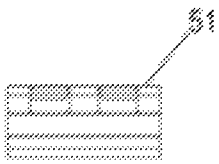
Figure 8A:
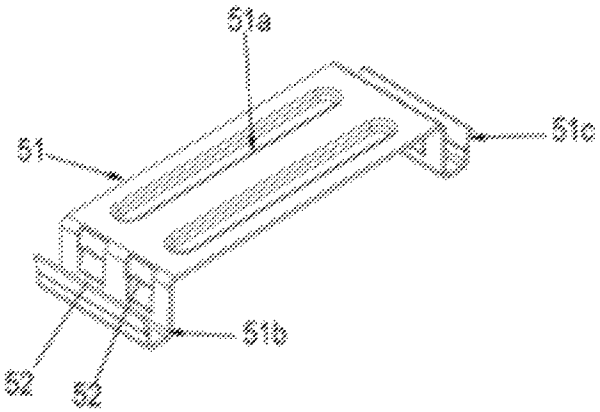
Figure 8C:
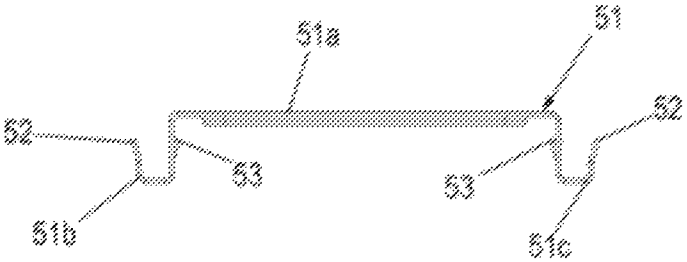
Figure 8D:
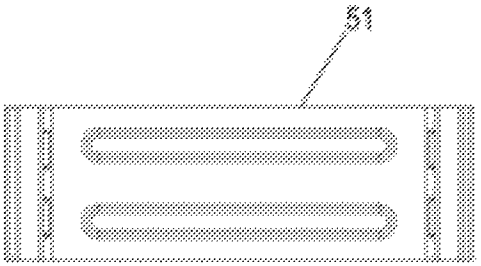
Figure 9:
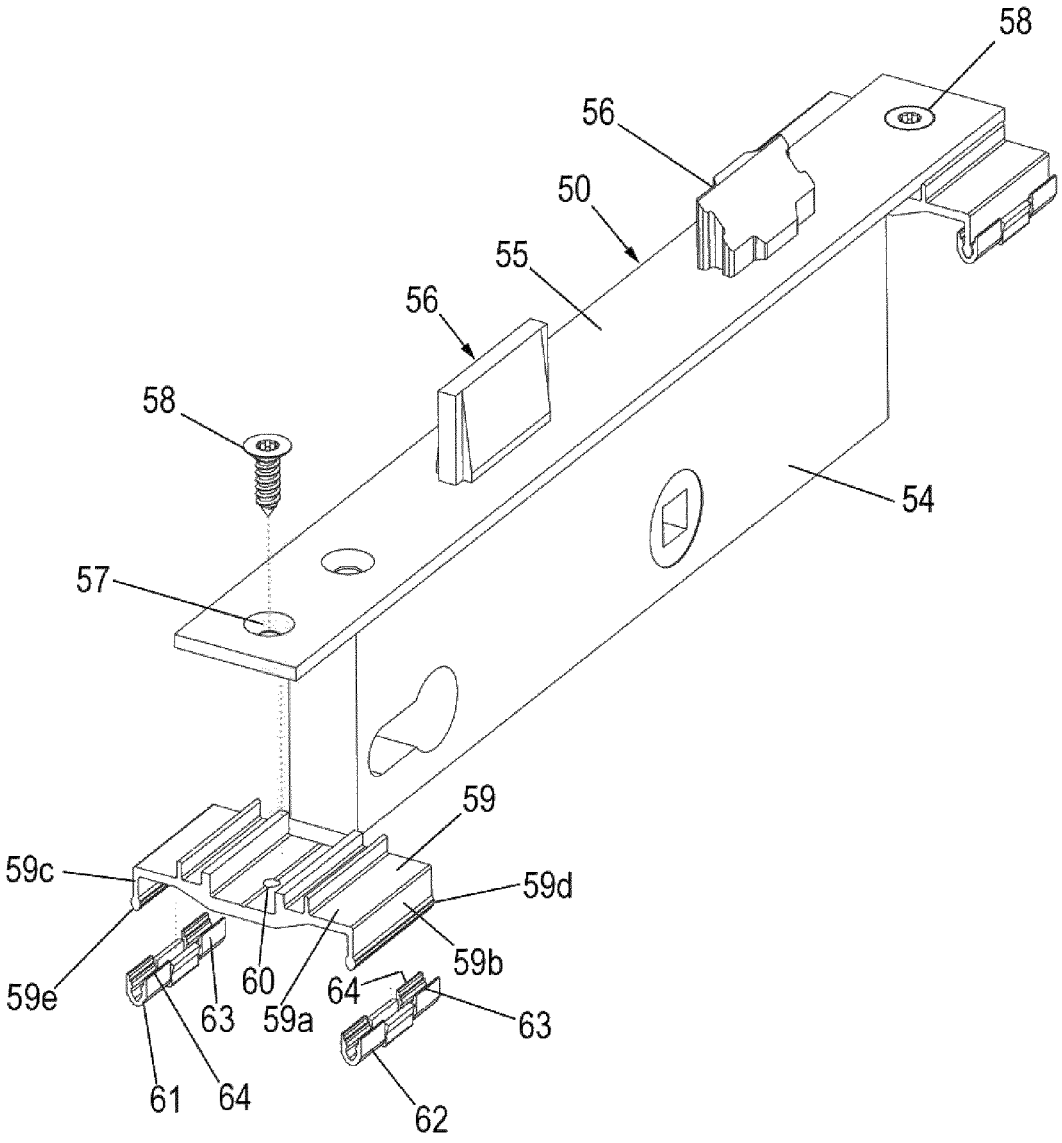
Figure 10:
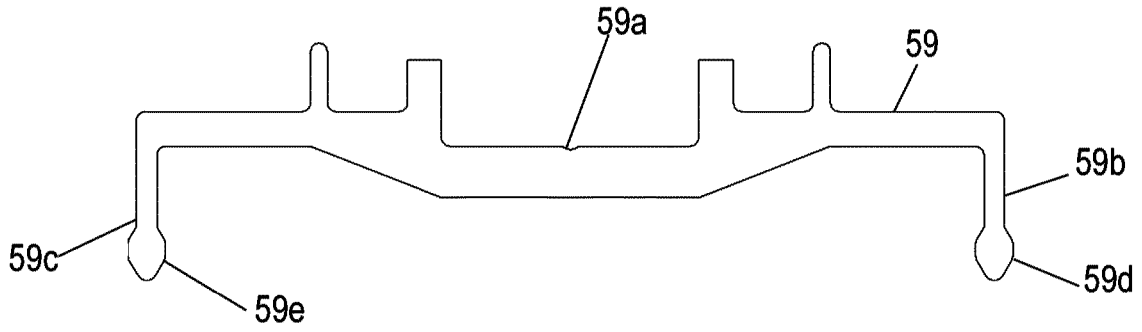
Figure 11B:
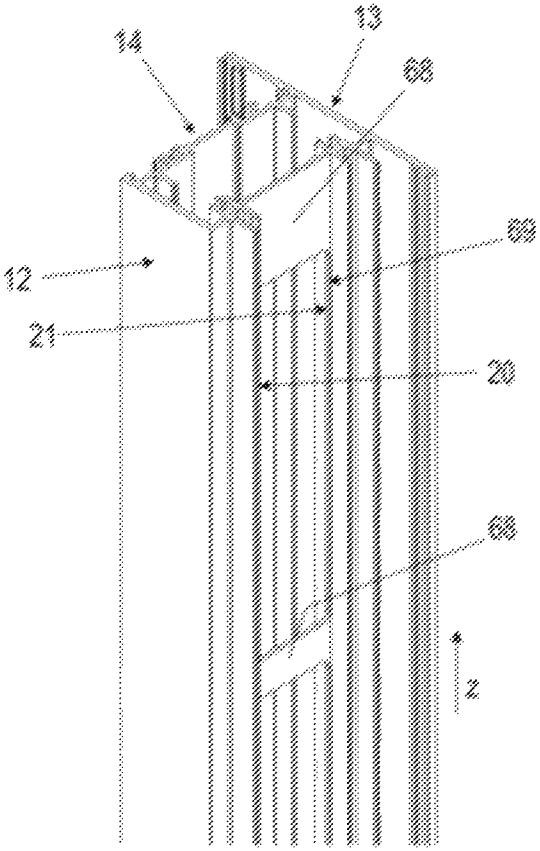
Figure 11A:
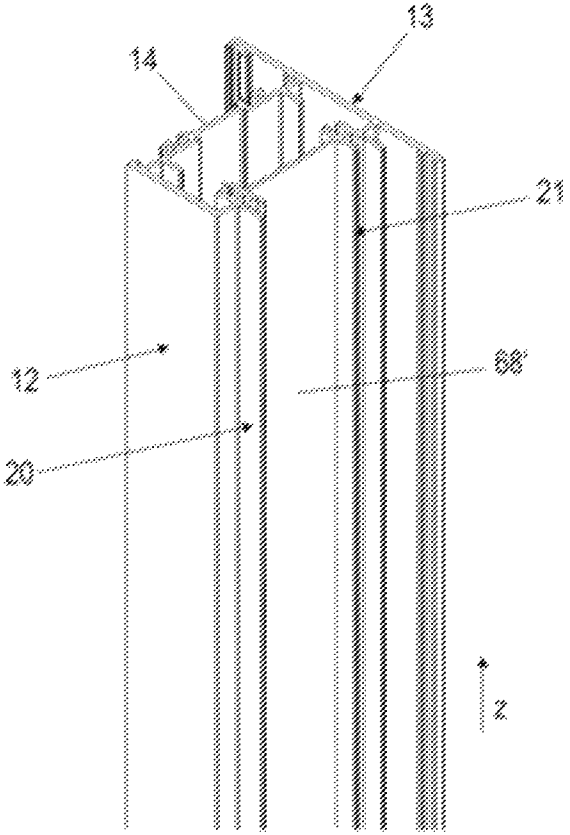
Figure 12:
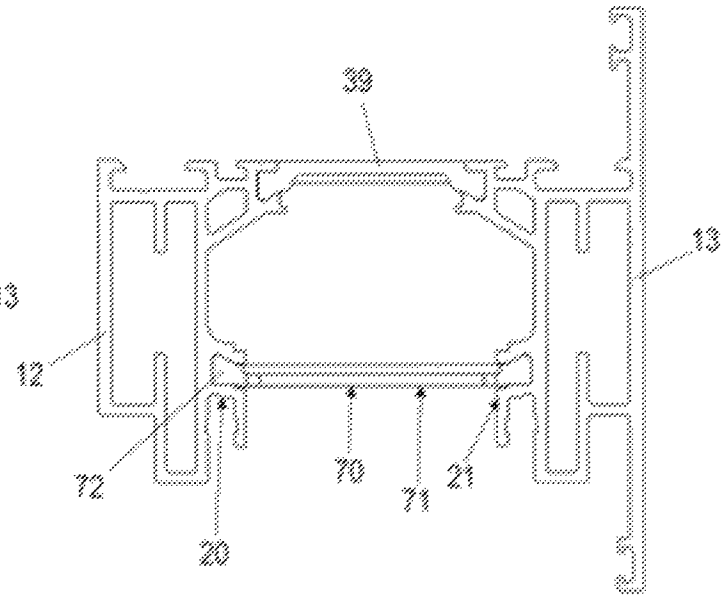
Figure 11C:
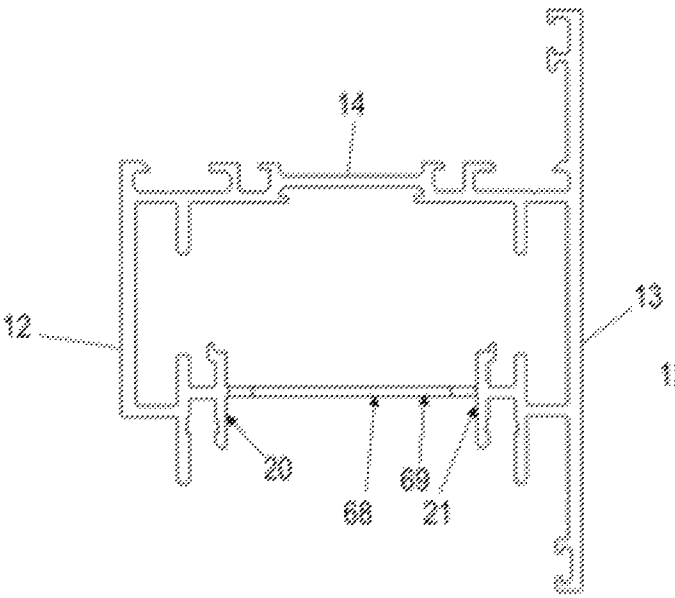

FIG. 3 shows, in a), a section through a sash spar and a frame spar of a further door of the type according to FIG. 1 in the closed state, in b), a sectional illustration of a main profile of the leaf from a), in c), a perspective illustration of the main profile from b) in a top view, in d), a further perspective view of the main profile from c) in a view from below; in e), a schematic view of an insulating web of the main profile from a) to d), and, in f), the arrangement from a) with corner connectors and cooling strips;

FIG. 4 shows a sectional illustration of a third main profile for a sash spar;

FIG. 5 shows the main profile of the sash spar from FIG. 3, provided with a cover profile;

FIG. 6 shows, in a) to f), sectional views of various cover profiles;

FIG. 7 shows, in a), a perspective view of a main profile with a lock assembly, with cover profiles, and with a profile clamp which is concealed per se but is visibly illustrated here, and, in b), the arrangement from a) without cover profiles, so that the profile clamp is partially directly visible;

FIG. 8 shows, in a) to d), various views of the profile clamp from FIG. 7; and FIG. 9 shows a perspective view of a lock comprising a carrier arrangement for fittings, in a preassembly position and in an exploded view;

FIG. 10 shows a carrier of the carrier arrangement from FIG. 9 in a side view;

FIG. 11 shows, in a), a perspective view of a first variant of a first main profile after an extrusion and before an introduction of recesses, in b), the main profile from a) after an introduction of the recesses, and, in c), a sectional illustration of the main profile from b); and FIG. 12 shows a sectional illustration of a second variant of a first main profile.

DETAILED DESCRIPTION

Figure 1:
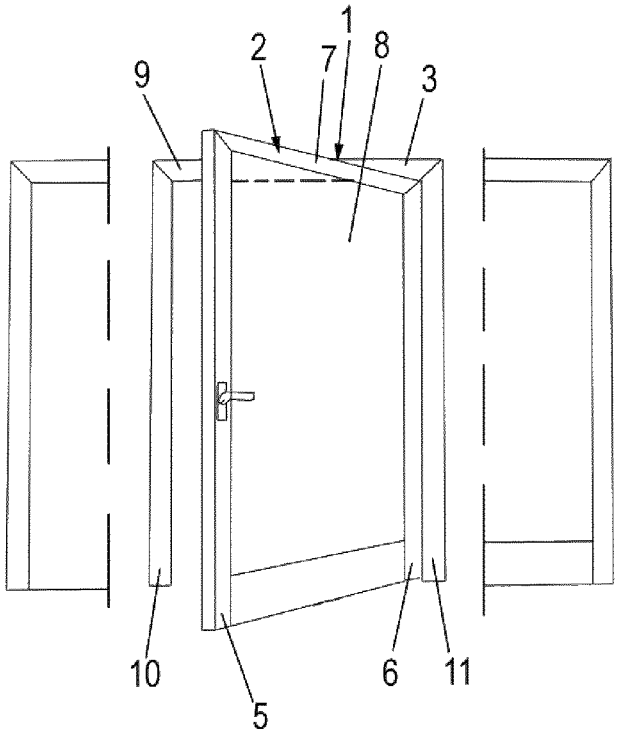
FIG. 1 shows a door comprising a frame and a leaf arranged so it is rotatable thereon, which is shown in an open position.

FIG. 1 shows a door 1, which has a leaf comprising a sash 2, which is arranged on a frame 3. The sash 2 is mounted so it is rotatable on the frame 3 here.

In FIG. 1, the door 1 is shown as a pivoting door comprising door hinges. Alternatively, the door 1 can also be embodied as a sliding door. Alternatively to the door 1 shown in FIG. 1, the present invention can also be applied in windows or façade elements. If the term door is used hereafter, it can therefore also be replaced by the terms "window" or "façade element". The door can be arranged so it is rotatable (vertical axis of rotation) and/or pivotable (horizontal axis of rotation) on the sash.

By way of a corner connection of perpendicular sash spars 5, 6 to an upper horizontal sash spar 7, the profile composite forms the at least U-shaped sash 2. A planar element 8 such as an insulating glass pane or a fire protection glazing or a metal or plastic plate is inserted into the sash 2. The sash 2 and the planar element 8 form the leaf together. Moreover, the concept of the "window" is also to be understood in the scope of this description and the claims as a fixed glazing comprising a planar element in a frame 3.

The frame 3 of the door 1 is also U-shaped here and has a horizontal frame spar 9 and two vertical frame spars 10, 11.

The sash 2 and/or the frame 3 can alternatively also be designed as circumferentially closed and can have further lower horizontal spars.

Individual ones or all of the frame spars and/or sash spars have a main profile 300 (frame) or 400 (sash) having a substantially U-shaped cross section.

The main profile 300 and/or 400 can respectively be formed in one piece or multiple pieces as a composite profile. A one-piece variant of the main profile 300, 400 is shown in FIGS. 1, 2*a*, and 2*b* and also 11 (only 400 here) and two multipiece variants of the main profile 300, 400 are shown in FIGS. 3 and 4 (only 400 here).

Initially, the one-piece variants of the main profile 300, 400 from FIGS. 2*a, b, c* will be considered and then the multipiece variants of FIGS. 3 and 4 will be explained.

Figure 2A:
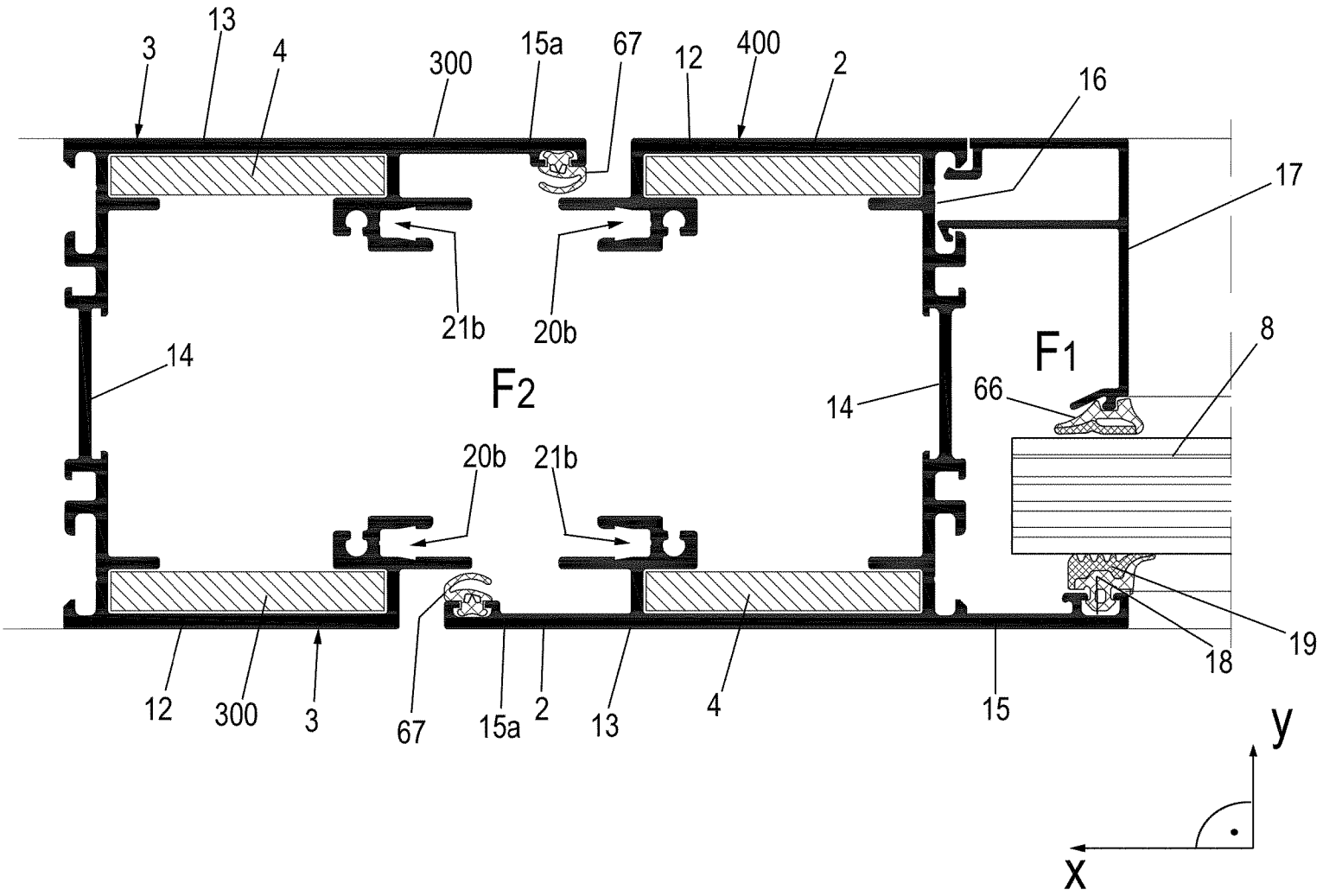
FIG. 2 shows in a) a section through a sash spar and a frame spar of a door of the type according to FIG. 1, but in the closed state; in b), a sectional illustration of a first main profile of the leaf from a), and in c), a perspective illustration of the main profile from b) in a top view.

According to FIGS. 2*a* and 2*b*, each main profile 300 and/or 400 has a short leg 12 and a long leg 13. The short leg 12 and the long leg 13 extend parallel to one another. They are connected to one another toward the end regions thereof via a transverse leg 14—preferably extending perpendicularly to the short leg 12 and the long leg 13.

The transverse leg 14 forms a base web of the U-shaped main profile 300, 400 and the short leg 12 and the long leg 13 form two parallel longitudinal webs of the U-shaped main profile. According to FIG. 2, the short leg 12, the long leg 13, and the transverse leg 14 are formed in one piece. The main profiles 300, 400 of FIG. 2 preferably consist of a metal, in particular of a light metal or a light metal alloy, thus particularly preferably of an aluminum alloy. The term "substantially U-shaped cross section" thus means here and also in the scope of the claims that the two legs extending perpendicularly to the (first) transverse leg 14—the short leg 12 and the long leg 13 here—are directly or indirectly connected to one another not at all or only in sections (over less than half of the length or extension thereof in the main extension direction Z) via a further, second transverse leg at the ends facing away from the transverse leg 14 connecting them (in particular in a state ready for installation or after installation, i.e., in a final installation state in an assembled window frame or an assembled doorframe or an assembled façade element frame) in the main extension direction Z (see also FIG. 2*c*) of the main profile.

The long leg 13 of the main profiles 300, 400 is longer than the short leg 12 in a direction perpendicular to the main extension direction X (see FIGS. 2*c* and 2*b*) of the main profile (i.e., in the section of the image plane of FIG. 2*a*). The directions X and Y extend in the plane of section of FIG. 2*a* or 2*b*. In this case, the short leg 12 and the long leg 13 are formed parallel to one another in the X direction, while the transverse leg 14 extends perpendicularly thereto in the Y direction. The long leg 13 of the main profile 400 of the sash 2 can lie on the outside at a building opening, for example, at a window. Alternatively, however, it can also lie on the inside. Moreover, the main profile 400, 300 can also be a part of a door or a window which lies completely in the building interior and divides or terminates a corridor, for example.

The transverse leg 14 of the sash 2 lies in the sash 2 (FIGS. 2*a*, 3*a*, 3) adjacent to the planar element 8. The transverse leg 14 thus delimits the rabbet space F21 between the main profile 400 and this planar element 8. A glazing bead 17 (FIGS. 2*a*, 3*f*) and at least one seal 19 can be attached to the transverse leg 14. A further seal 66 (FIGS. 2*a*, 3*a*) can be arranged between the glazing bead 17 and the planar element 8. The short leg and the long leg 12, 13 are aligned parallel to one another.

The long leg 13 of the main profile 400 of the sash 2 protrudes with a free end 15 beyond the transverse leg 14.

A glazing bead groove 16 for fixing a glazing bead 17 is formed outward toward the rabbet space F1 on the transverse leg 14 of the main profile 300, 400. A seal groove 18 for arranging a seal 19 between the planar element 8 and the long leg 13 is provided at the free end 15 of the long leg 13 on the side oriented toward the planar element 8 (see in this regard also FIG. 2*b*, where the main profile 400 thus has identical contours 16, 18).

Both the short leg 12 and also the long leg 13 of the main profile 300, 400 have function contours 20, 21 respectively arranged on the short leg 12 and also on the long leg 13, in particular entirely or partially protruding therefrom, on the inner sides thereof facing toward one another. These function contours 20, 21 are preferably formed as multi-function contours, which fulfill/implement not only one but rather multiple functions.

The multifunction contours according to FIG. 2*b* thus form:

a) a corner connector receptacle groove 20*a*, 21*a* for accommodating a corner connector;
b) a fastening groove 20*b*, 21*b*; and
c) a receptacle groove 20*c*, 21*c* for accommodating a preassembly web 22.

It is advantageous if the function contours 20, 21 form at least two of the above-mentioned grooves a) to c). They particularly preferably each form three or even more of the function grooves or at least parts of this groove/these grooves.

For this purpose, the function contours 20, 21 respectively comprise at least one transverse leg 23 or 24, which protrudes perpendicularly from the short leg 12 or the long leg 13, respectively (see also FIG. 2*b*).

A parallel web 25, 26 is formed in each case at the respective end of these transverse legs 23, 24, which extends parallel to the actual short leg 12 or the long leg 13, but is shorter than these legs. Overall, the respective transverse leg 23, 24 and the parallel web 25, 26 essentially form a T shape in cross section.

In this manner, the short leg 12 or the long leg 13 and the one transverse leg 23 or the other transverse leg 24 and the one parallel web 25 or the other parallel web 26 respectively form the corner connector receptacle groove 20*a*, 21*a*.

The one edge of corner connectors 4 is inserted into each of the corner connector receptacle grooves 20*a*, 21*a*. It is advantageous that the two corner connector receptacle grooves 20*a*, 21*a* are dimensioned equally such that identical corner connectors 4 are insertable therein, as this simplifies the installation of the frame (frame and sash 3, 2).

The other edges of the two corner connectors 4 engage in further corner connector grooves 28*a, b*, which are delimited by short holding webs 29, 30 protruding from the transverse leg 14, the transverse leg 14, and the short leg 12 or the long leg 13, respectively.

The fastening grooves 20*b* and 21*b* are formed by the parallel webs 25, 26 and the angled webs 31, 32 formed thereon on the sides facing toward one another.

The parallel webs 25, 26 and the angled webs 31, 32 thus each form fastening grooves 20*b*, 21*b* open toward a rabbet space F2 toward the frame 3.

These fastening grooves 20*b*, 21*b* are preferably not designed as threaded grooves for the rotating fixing of threaded elements. Rather, they are preferably designed for fixing fastening elements preferably acting in an interlocking and/or frictional manner, which are fixable by a linear movement in the fastening grooves 20*b*, 21*b*. For this purpose, the fastening grooves 20*b*, 21*b* are U-shaped and are each open toward the rabbet space F2 toward the frame 3. This facilitates the insertion of the fastening elements into the fastening grooves 20*b* and 21*b*. Preferably used fastening elements for the fastening grooves 20*b*, 21*b* will be described in greater detail hereafter. The fastening grooves 20*b*, 21*b* preferably have catch means such as one or more undercuts, which can interact with corresponding catch means such as one or more catch edges.

The receptacle grooves 20*c* and 21*c* are used to accommodate the preassembly web 22, which is arranged between the receptacle grooves 20*c* and 21*c* and connects them over the length of the main profile 300 or 400 like a bridge and also in the Z direction in sections or preferably continuously. The preassembly web can extend in the Z direction continuously over the entire length of the main profile 300, 400 or can consist of individual parts, which are each only a few centimeters long and are placed at intervals, for example.

The preassembly web 22 is guided so it is displaceable in the receptacle grooves 20*c* and 21*c* in the main extension direction Z (see FIG. 2*c*) of the main profile 300, 400 in each case perpendicularly to the plane of section of FIG. 2*b*. It is used to form the corner regions of the frame to be produced and holding the short leg 12 and the long leg 13 at a distance in a defined manner during a preassembly—i.e., during the processing before the assembly of the frame—and in this case in particular during the cutting of miter cuts at edges, and is removed during or after the preassembly, preferably after the cutting of the miter cuts. It is embodied sufficiently stably that it counteracts a force compressing the main profile, as can arise during sawing, and therefore a defined distance is maintained between the ends of the short leg 12 and the long leg facing away from the transverse leg 14 during the cutting of the miter cuts.

The receptacle grooves 20*c* and 21*c* are formed as preferably undercut grooves, which are open on sides facing toward one another—in a direction parallel to the transverse leg 14.

The preassembly web 22 has a middle web 22*a* and interlocking contours 33, 34 at the two ends of the middle web 22*a*, using which it is insertable into the receptacle grooves 20*c*, 21*c* and displaceable therein. The interlocking contours 33, 34 are therefore preferably designed corresponding to the cross section of the receptacle grooves 20*c*, 21*c* and therefore they engage with little play therein, such that the preassembly web 22 is displaceable in the receptacle grooves 20*c*, 21*c* (perpendicularly to the image plane of FIG. 2*a*). In this manner, the production of the frame spar is optimized and simplified in a simple manner. In particular, it is possible by way of the removable preassembly web 22 to space apart the short leg 12 and the long leg 13 of the main profile 300 or 400 in a defined manner at the ends thereof facing away from the transverse leg 14, in order to carry out miter cuts on the main profile 400 in a simple manner with high accuracy. Before the assembly of the main profiles 300, 400 to form a frame, the preassembly webs 22 are then removed, and therefore space advantageously results for other functional elements in this region. The preassembly web or webs preferably consists of plastic or light metal such as aluminum. However, they can also consist of other materials which can be sawn through easily.

In each of FIGS. 3*a* and 3*b*, the main profile 300, 400 is designed substantially similarly to the main profile or the main profiles of FIG. 2. The above statements are therefore substantially also transferable to the main profiles 300 and 400 of FIGS. 3 and 4 to 10.

However, there are also several differences, which will be explained hereafter.

The main profile 300 or 400, respectively, of FIGS. 3 and 4 is thus formed in multiple pieces as a composite profile.

The main profile 300, 400 of FIGS. 3*a* and 3*b* also has the short leg 12 and the long leg 13 (preferably made of metal, in particular consisting of an aluminum alloy). The short leg 12 and the long leg 13 also extend parallel to one another. Furthermore, they are also connected to one another via a transverse leg 14—preferably extending perpendicularly to the short leg 12 and the long leg 13, wherein the transverse leg 14 forms a base web of the U-shaped main profile 300, 400 and the short leg 12 and the long leg 13 form the two parallel longitudinal webs of the U-shaped main profile 300, 400.

However, the transverse leg 14 of the main profiles 300, 400 of FIGS. 3 and 4 is formed as at least one separate insulating web 39 (FIG. 3*b*) or as a composite made of multiple insulating webs (FIG. 4: two parallel insulating webs 39*a, b*), which is/are connected in an interlocking and frictional manner to the short leg 12 and the long leg 13, preferably such that a composite which is shear-resistant perpendicular to the plane of FIG. 3*a* is formed.

In this case, at least one insulating web 39 (FIGS. 3, 5) made of insulating material such as plastic can be used or two insulating webs 39*a, b* (FIG. 4) made of insulating material such as plastic can be used (preferably directly adjacent to one another as one transverse leg).

Figure 3E:
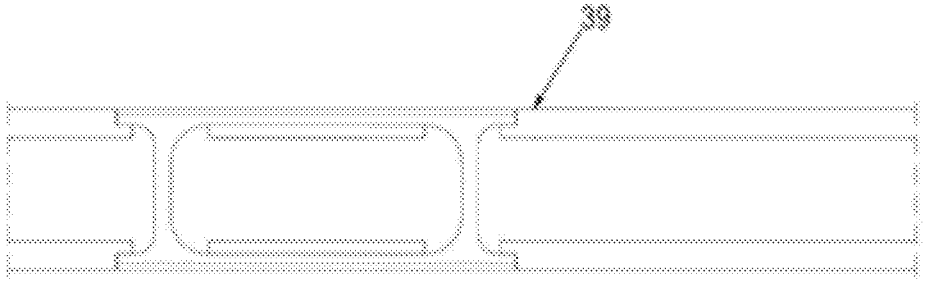

The at least one insulating web 39 made of plastic can optionally alternatively have a metal main structure or individual metal webs in the plastic, which form bridges between the short leg 12 and the long leg 13 and in this manner optimize the statics (see in this regard by way of example EP 1 138 864 B1 of the same applicant and FIG. 3*e*). The thermal insulation is again locally reduced somewhat in this way. However, a support structure results in this manner, which offers improved thermal insulation in relation to the one-piece transverse leg 14, on the one hand, and is sufficiently stable that it is well suitable for use in fire and/or smoke protection doors, on the other hand. The insulating web 39 can also have an array of recesses in the main extension direction Z itself.

The short leg and the long leg 12, 13 according to FIG. 3 or 4 are not formed as simple webs made of solid metal as shown in FIG. 2, but preferably are provided with at least one hollow chamber 37, 38. The short leg 12 and the long leg 13 otherwise again consist of a metal, in particular of a light metal or a light metal alloy, thus preferably of an aluminum alloy.

The long leg 13 also protrudes beyond the transverse leg 14 with one free end 15 or two free ends according to FIGS. 3 and 4. The glazing bead groove 16 for fixing the glazing bead 17 is again formed on the transverse leg 14 of the sash main profile 3 toward the rabbet space F1. The seal groove 18 for arranging the seal 19 between the planar element 8 and the long leg 13 is provided at the free end 15 of the long leg 13 on the side oriented toward the planar element 8.

The corner connector receptacle grooves 20*a*, 21*a* can also be used for accommodating fire protection strips having cooling effect, in particular in the regions of the main profiles 300, 400 adjoining the corner connectors.

Both the short leg 12 and also the long leg 13 have the function contours 20, 21 on the inner sides thereof facing toward one another. These function contours 20, 21 are also preferably formed according to FIGS. 3*a* and *b* and 4 as multifunction contours, which fulfill/implement not only one but rather multiple functions. The multifunction contours of FIGS. 3 and 4 even thus advantageously each form four function grooves here:

a) the corner connector receptacle groove 20*a*, 21*a* for accommodating one corner connector 4 in each case;
b) the fastening groove 20*b*, 21*b;*
c) the receptacle groove 20*c*, 21*c* for accommodating the preassembly web 22, and
d) respectively one receptacle groove 20*d*, 21*d* for accommodating a cooling strip 65 between the corner connector receptacle groove 20*a*, 21*a* and the fastening groove 20*b*, 21*b*.

Figure 3D:
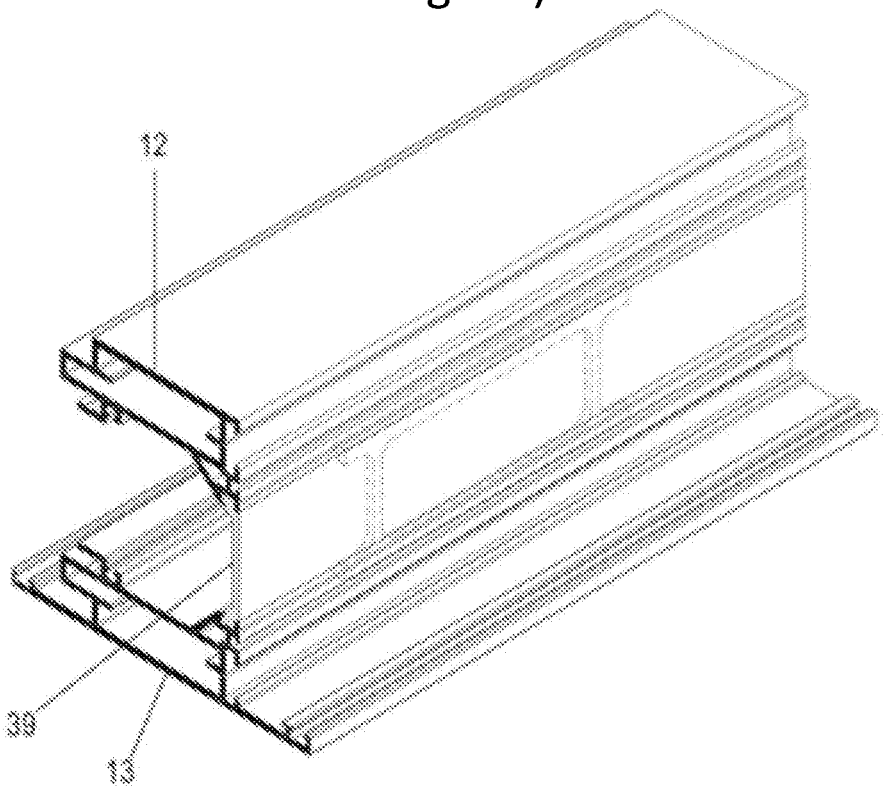

Both the corner connector receptacle groove 20*a* for accommodating the corner connectors 4 and also the receptacle groove 20*d* for accommodating the cooling strips 65 are each formed in this case in the hollow chambers 37, 38 of the short leg 12 or the long leg 13, respectively. Cooling strips 65 are those strips which can absorb a certain amount of fire heat or energy and/or can actively cool in case of fire. They can consist of a molded body having a high heat capacity, for example, of concrete. However, they can also consist of one or more molded bodies which contain heat-binding hydrophilic adsorbent (see, for example, DE 197 00 696 C and DE 4443762 A1). The receptacle grooves 20*d*, 21*d* for respectively accommodating a cooling strip 65 can be seen in FIGS. 3*a* and 3*d* and also 3*f* and 4.

For this purpose, the functional contours 20, 21 each in turn comprise (see, for example, FIG. 4) a short transverse leg 23 or 24 at the short leg 12 or the long leg 13, respectively.

A parallel web 25, 26 is formed at the respective end of these transverse legs 23, 24, respectively, which extends parallel to the inner profile 12 or the outer profile 13 but is shorter than these. Overall, the respective transverse legs 23, 24 and the parallel webs 25, 26 essentially form a T shape in cross section. In this manner, the inner profile 12 or the outer profile 13 and the one transverse leg 23 or the other transverse leg 24 and the one parallel web 25 or the other parallel web 26 respectively form the corner connector receptacle groove 20*a*, 21*a*.

Figure 3F:
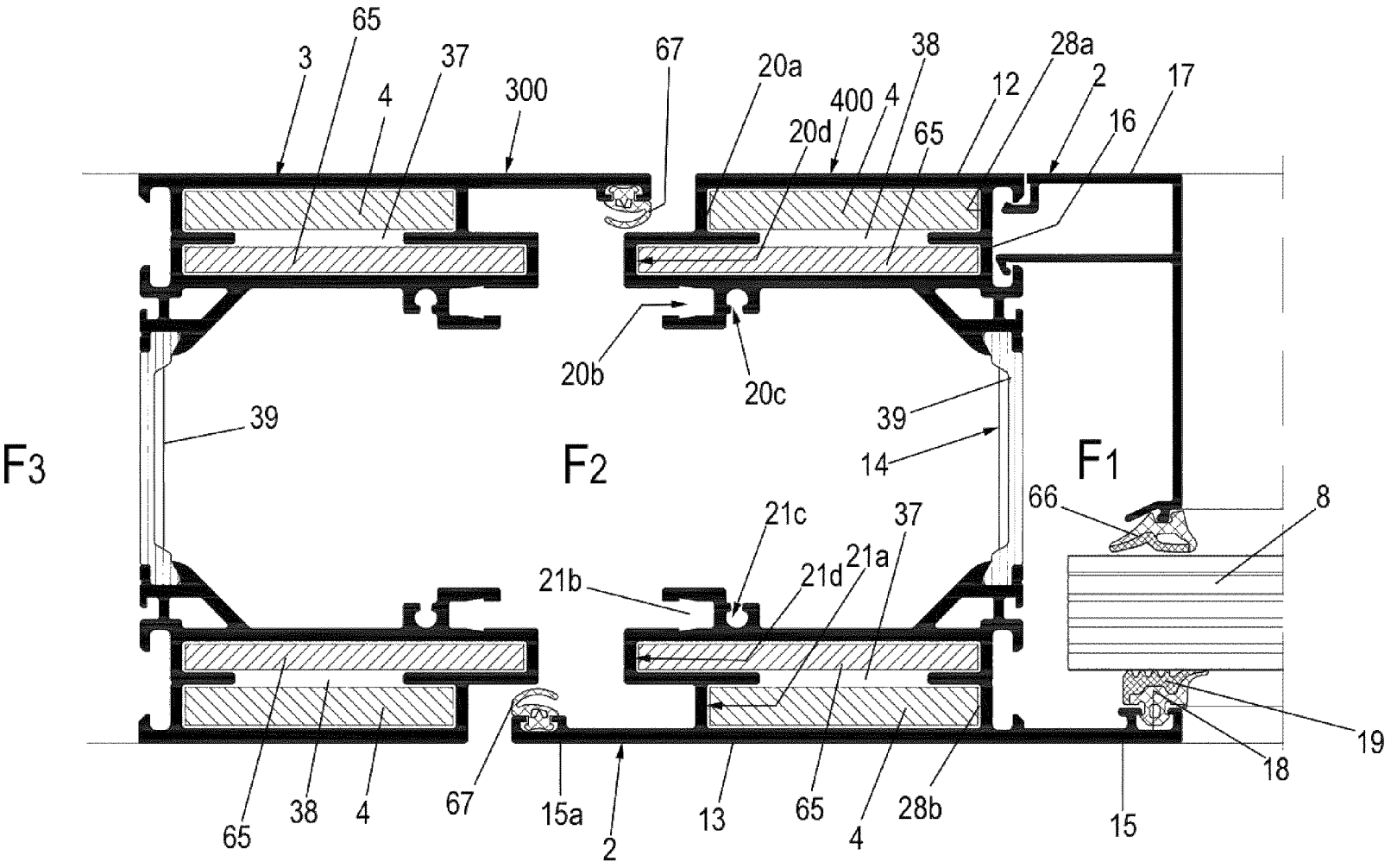

The edges of a total of two corner connectors 4 are in turn inserted into each of the corner connector receptacle grooves 20*a*, 21*a* (see FIGS. 2*a* and 3*f*). It is advantageous that the two corner connector receptacle grooves 20*a*, 21*a* are dimensioned identically such that identical corner connectors 4 are usable therein, since this simplifies the installation of the window and the stock keeping. Moreover, identical corner connectors are also usable both in the main profiles 400 of the sash 2 and also into the main profile 300 of the frame 3.

The edges of the two corner connectors 4 engage in the further corner connector grooves 28*a, b*, which are delimited by short holding webs 29, 30 formed in the hollow chambers 37, 38, the transverse leg 14, and the short leg 12 and the long leg 13.

The fastening grooves 20*b* and 21*b* are delimited by webs 40, 41 of the short leg 12 and the long leg 13 and are partially formed with them, which delimit the hollow chambers 37, 38 toward the transverse leg 12 or on the sides facing toward one another, and angled webs 31, 32 formed thereon on the sides facing toward one another.

In this manner, the further (parallel) webs 40, 41 and the angled webs 31, 32 each form the fastening grooves 20*b*, 21*b* open toward the further rabbet F2 toward the frame. These fastening grooves 20*b*, 21*b* are preferably not designed as threaded grooves for the rotating fixing of threaded elements. Rather, they are preferably designed for fixing fastening elements preferably acting in an interlocking and frictional manner, which are fixable by a linear movement in the fastening grooves 20*b*, 21*b*. However, the fastening grooves 20*b*, 21*b* are also formed for this purpose in FIG. 3 and FIG. 4 such that they are U-shaped and are each open toward the rabbet F2 toward the frame 3. The fastening grooves 20*b*, 21*b* are formed like simple undercut grooves. They are thus easily structurally implementable on the main profile 300, 400.

The receptacle grooves 20*c* and 21*c* are in turn used to accommodate the preassembly web 22, which is arranged between the two receptacle grooves 20*c* and 21*c* and continuously connects them. The preassembly web 22 is formed as shown in FIGS. 2*b, c*. The receptacle grooves 20*c* and 21*c* are formed as undercut grooves, which are open on sides facing toward one another—in a direction parallel to the transverse leg 14. They are formed on the sides of the webs 40, 41 facing toward one another.

In FIG. 4, the main profile 400 is designed substantially similarly to that of FIG. 3. The insulating web 39 consists of two individual webs extending parallel to one another, however, which lie almost together and are each connected in an interlocking and frictional manner like a shear-resistant composite to the short leg 12 and the long leg 13.

Because the preassembly web 22 has been removed after the application of the miter cuts (which is possibly preceded by powder coating of the main profile 400), the main profile is open between the short leg 12 and the long leg 13 on the side facing away from the main leg 14. This is the side lying toward the rabbet F2, i.e., toward the frame 3.

FIGS. 2 and 3 illustrate that it is possible to design the main profiles 300 of the frame 3 as substantially structurally equivalent to the main profiles 400. Nearly all statements on the sash 2 that have been made above thus also apply to the frame 3. The frame 3, however, has a first outer rabbet region F3 not facing toward a planar element but rather toward masonry and a second rabbet region, which is the rabbet region F2 between the sash 2 and the frame 3.

One difference is that in the main profile 400 of the sash, a longer web (the free end 15) is provided on the outer profile 13 than on the main profile of the frame 3. This longer web is used to cover the planar element 8 in the edge region and holding it around the seal 19 toward the planar element 8 (FIG. 3*f*). Toward the rabbet F2, both the main profile 400 of the sash 2 and also the main profile 300 of the frame 3 have a free end 15*a* on the outer profile 13, to laterally terminate the rabbet F2.

A further seal 67, to seal the rabbet F2, is arranged on each of these further free (protruding) ends 15*a* on the inside toward the rabbet F2. The contours of the main profile 300 of the frame 3 and the main profile 400 of the sash 2 are identical toward the rabbet F2 but are located diagonally opposite to one another.

A second difference between the main profiles 300 and 400 of the frame 3 and the sash 2 is that the short leg 12 and the long leg 13 are located diagonally opposite to one another on the installed window or on an installed door (see FIG. 3*f*). The short leg and the long leg 12, 13 are again aligned parallel to one another.

It can be desirable and can be considered to be advantageous if it is possible to again close the open side of the U-shaped main profile 300, 400 toward the rabbet F2 between the frame 3 and the sash 3 (for example, after the removal of the preassembly profile 22) using a visually appealing element, and advantageously to form a dust and vision protection toward the rabbet F2 in a simple manner. Moreover, a more visually appealing view toward the rabbet F2 is desired than offered by the preassembly profile 22.

It is therefore advantageous if, as illustrated in FIG. 5, the open side of the main profile 300, 400 of the sash spar and/or the frame spar located toward the rabbet F2 is entirely or partially covered using at least one or more cover elements, in particular one or more cover profile(s) 42. It is thus advantageous that the fastening grooves 20*b*, 21*b* are usable for fixing such a cover element or are preferably also used in the final installation state.

The cover profile 42 preferably lies completely between the short leg 12 and the long leg 13 and terminates flush with these two legs 12, 13 on the side facing away from the transverse leg 14. The cover profile 42 aligns there with two transverse webs 35, 36, with which it defines a or the visible plane E1. The free space or gap between the short leg 12 and the long leg 13 is thus simply covered in a visually appealing manner. This is the primary function of the cover profile. According to one preferred variant, it is not an element statically supporting and elevating the stability of the main profile 400, 300 in a noticeable manner between the ends of the short leg 12 and the long leg 13 facing away from the transverse leg 14. Rather, it primarily has the function of a visual cover, a dust and dirt safeguard, and possibly a fire protection function, the latter in an optional embodiment and design which will be explained in greater detail hereafter. Alternatively, however, it is also conceivable that the cover profile connects the two legs 12, 13 statically as a (thermally) insulating element.

It is advantageous that the short leg 12 and the long leg 13 end in the region of the transverse webs 35, 36 at the ends of the parallel webs 25, 26 externally at the common plane E1 parallel to the transverse leg 14 (Y direction).

The cover profile 42 of FIG. 5 and the following figures is U-shaped in cross section in each case. It has two catch feet 43, 44 (FIG. 6*a*), which are connected to one another by a cover leg 45 extending transversely thereto, as fastening elements and as counter catch means to the catch means of the fastening grooves 20*b*, 21*b*. The catch feet 43, 44 each engage in one of the two fastening grooves 20*b*, 21*b*, which are open toward the rabbet F2 and have undercuts 46 to establish a catch connection. The catch feet 43, 44 are insertable perpendicularly to the transverse leg into the fastening grooves 20*b*, 21*b*. The catch feet 43, 44 are preferably designed as combined catch/clamping feet, which engage not only in a locking manner but rather also somewhat in a clamping manner in the fastening grooves 20*b*, 21*b*. Nonetheless, the cover profile 42 remains easily displaceable in the fastening grooves 20*b*, 21*b* in the longitudinal direction thereof.

The catch feet 43, 44 can have greatly varying geometries. They can consist, for example, of solid material and can have outer catch edges (FIG. 6*a*) or can each be formed from two individual webs 45*a, b* having catch edges, which are elastically compressed upon insertion (FIG. 6*b*) or can be formed as hollow webs (FIGS. 6*c* to 6*f*), which are elastically compressed upon insertion into the fastening grooves 20*b*, 21*b*.

The cover profile or profiles 42 can moreover be formed in one piece or multiple pieces. Moreover, they preferably consist of plastic (such as PVC, PP) or a fire protection material or a combination of these two materials. If they consist of a combination of these two materials, they preferably have a U-shaped fire protection bridge 47, with which the catch feet 43, 44 are associated, and a transverse web or cover leg 45 connecting them, which forms a part of the cover profile 42. The cover profiles 42 are preferably composed and designed such that required pieces can be cut off from them easily, for example, using scissors.

Figure 6F:
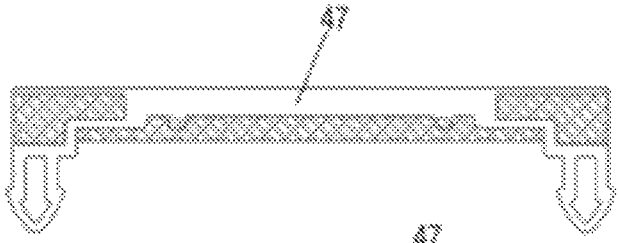
Figure 6E:
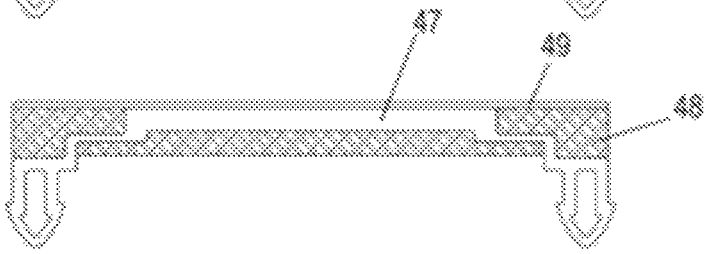
Figure 6D:
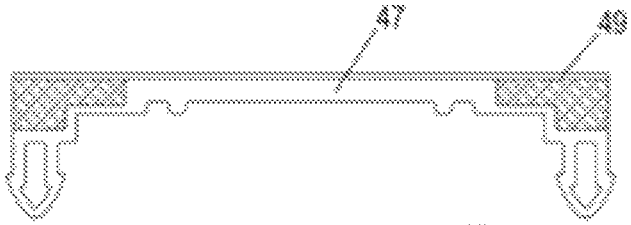
Figure 6C:
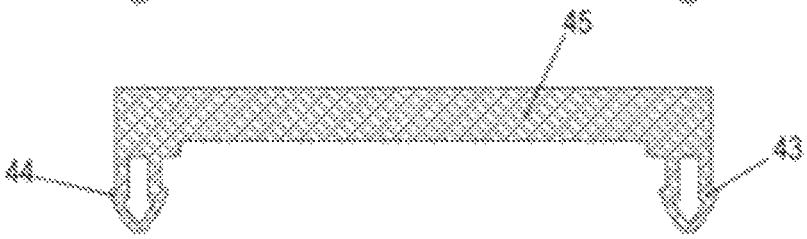
Figure 6B:
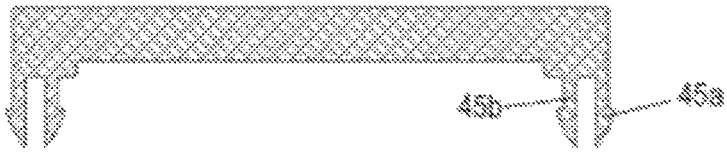
Figure 6A:
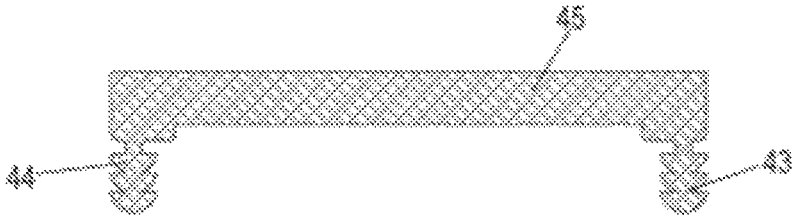

The cover leg 45 is preferably enclosed or covered on one of its sides or on both sides and/or at least in corner regions using fire protection material, and therefore fire protection regions 48 are formed (FIG. 6*d*). In this case, a cover layer 49 can be provided on the cover leg 45 toward the rabbet. It can consist of arbitrary material. It is preferably formed as a hard plastic layer or plate and is, for example, poured on or adhesively bonded or was formed in the coextrusion method. The fire protection regions 48 consist of a fire protection material. This is a material which foams under the effect of temperature in case of fire and conceals the rabbet F2. The access of hot flames and/or fire gases to the rabbet between the frame and the sash is thus made more difficult or blocked entirely for some time (see, for example, DE 19700696 B4 on the background of these technologies).

As stated, in this manner a preferably planar surface toward the inside toward the rabbet F2 is implemented in a simple manner. In the longitudinal direction transverse to the image plane of FIG. 5, the entire gap between the short leg 12 and the long leg 13 or a part thereof can be covered.

The region of a lock assembly 50, which can be installed on the main profile 400 in a manner to be described hereafter, is preferably not covered by the cover profile.

FIGS. 7 and 8 then illustrate a further advantageous option of the invention. According to this option, profile clamps 51 are arranged on the main profile 400. In the meaning of this application, the profile clamps 51 are fitting parts which consist of metal.

One of the profile clamps 51 is depicted in FIG. 8. This profile clamp 51 has, in the side view of FIG. 8*c*, a U shape comprising a main leg 51*a* and two short longitudinal legs 51*b*, 51*c*. The main leg 51*a* can be provided with one or more reinforcing beads. The two longitudinal legs 51*b, c* are U-shaped per se. They form catch sections, each of which are designed to engage in one of the fastening grooves 20*b*, 21*b*. For this purpose, they have an angle 52 bent outward on the one hand, and a catch web 53 stamped out and bent over on three sides, on the other hand, wherein the angle 52 and the catch web 53 each form catch edges, which are designed to engage behind the undercuts 46 in the fastening grooves 20*b*, 21 in a locking manner (see, for example, FIG. 2*a*). In this case, the catch edges are preferably formed so sharp-edged that they claw fixedly into the fastening grooves, and therefore they are seated therein so they are not displaceable but rather are fixed therein in the main extension direction of the main profile 300 or 400, respectively. In the main extension direction Z of the main profile 300, 400, the profile clamps are preferably 10 to 50 mm long, in particular 20 mm to 40 mm. Furthermore, they are placed spaced apart from one another in the main extension direction Z, in particular at an interval of 300 to 800 mm, preferably 400 to 600 mm. They do not burn off in case of fire and therefore also stabilize the main profile 300, 400 in particular in case of fire. Moreover—in contrast to the cover profiles 42, they are connected to the main profile 300, 400 in a shear-resistant manner.

The main leg 51*a* is dimensioned sufficiently long in this case that it overlaps the interval between the fastening grooves 20*b*, 21*b*. The profile clamps 51 are preferably formed from sheet steel. This sheet steel is preferably very thin and preferably has a thickness between 0.5 and 1.5 mm. It is formed into a stamped/bent part. Because the profile clamps 51 consist of steel, they can be designed very stably. They are locked spaced apart from one another into the fastening grooves 20*b*, 21*b* and cut into the light metal of the main profile 300 or 400 therein. In this manner, they stabilize the main profile 400 of the sash or the main profile 300 of the frame, respectively, and hold the short leg 12 and the long leg 13 at a distance in a defined manner.

The profile clamps 51 are first locked on when possible miter cuts have been carried out on the main profile 300 or 400 and when the preassembly web 22 has been removed. In this manner, they cannot damage a saw or a saw blade during the sawing of the miter cuts. On the other hand, they have a very stabilizing effect on the profile, without noticeably increasing its weight. Because the longitudinal legs 51*b*, 51*c* of the profile clamps 51 are themselves U-shaped, it is even possible to also place the cover profile 42 on the profile clamps 51, when they have been fixed on the main profile 400 or 300, respectively, the cover profile then lying above the profile clamps 51 in the region thereof, and therefore they are not visible in the installed state. FIG. 7*a* illustrates this. The profile clamps then lie inside from the cover profiles 42.

The profile clamps 51 are locked on (like the cover profiles 42), preferably in the X direction perpendicular to the transverse leg 14.

At least one of the profile clamps 51 is preferably attached in each case on the main profile 400 of the sash 2 where a fitting part, by way of example and preferably, a lock assembly 50, is to be attached. On the sash, this is typically a lock assembly 50 comprising a lock 54 with cylinder and one or more movable bolt(s). The profile clamps 51 or one of the profile clamps 51 is arranged vertically directly below the lock assembly 50, and therefore it is additionally secured and vertically fixed on the main profile 400.

A preferred lock assembly 50 is shown in FIG. 9. This lock assembly consists of the actual lock 54, wherein the lock 54 has a striker plate 55, which is penetrated by one or more bolts 56. The striker plate has one or more boreholes 57, which can be penetrated by screws or one screw 58 each. The screw 58 is respectively designed for the purpose of engaging in a carrier element 59.

The carrier element 59 is preferably designed as a profile section. In particular, it is a profile section of a light metal profile, in particular of an aluminum profile. It is theoretically also conceivable to form the carrier element not as a profile section but rather as a stamped/bent part or the like or as a cast part. The screw 58 can be screwed into the carrier element 59. It can also have a central screw borehole 60 for this purpose. The carrier element 59 (see FIG. 10) moreover again has a U shape (in a side view) having a main leg 59*a* and two longitudinal legs 59*b*, 59*c* in this case, the two longitudinal legs 59*b*, 59*c* have thickened areas 59*d*, 59*e* at the ends thereof.

The longitudinal legs 59*b*, 59*c* are in turn spaced apart from one another such that they can engage in the fastening grooves 20*b*, 21*b* of the main profile (400 or 300). They are preferably not directly locked therein. Rather, they are designed for the purpose of engaging in securing clips 61, 62. For this purpose, the securing clips 61, 62 have catch edges 63, 64 at both ends thereof. These catch edges 63, 64 are provided at both ends in the securing clips 61, 62, which are U-shaped in cross section. Using them, the securing clips 61, 62 can be preinstalled on the carrier element 59. After the fastening of the fastening clips 61, 62, the entire lock assembly 50 can be inserted into the fastening grooves 20*b*, 21*b*, which in turn hold the lock assembly 50 in a locking manner (for example, like a so-called "hawk mouth").

The securing clips 61, 62 preferably consist of plastic. In this manner, greatly varying devices, in particular the preinstalled lock assembly 50 or other fitting parts or the like, can be fixed on the main profile 400 or 300 using the securing clips. In this manner, the lock assembly 50 comprising the lock 54 is securely fastened in a simple manner on the main profile 400 of the sash 2. In addition, the lock assemblies 50—as already described above—are fixed and/or secured against slipping using the profile clamps 51 on the main profile 400.

The carrier element 59 or the carrier elements can also be used for the simple and preferably tool-free fixing of another element or an assembly other than a lock assembly on the respective main profile 300, 400. Other fitting parts can thus be fastened in a simple and preferably tool-free manner using them.

FIG. 11 shows, in a) and b), a perspective view of a first variant of the first main profile 400 from FIG. 2 and FIG. 12 shows a sectional illustration of a variant of the first main profile 400 from FIG. 3.

The main profile 400 (or an associated main profile 300 (not shown here)) of FIGS. 11*a*) and *b*) is formed in one piece. It consists of light metal, in particular of an aluminum alloy. It is preferably formed as an extruded profile.

The variant of the main profile 400 (or an associated main profile 300 (not shown here), respectively) of FIG. 12 is formed in multiple pieces, in contrast. It consists of light metal, in particular of an aluminum alloy, and has insulating webs. It is preferably formed as an extruded profile.

Multifunction contours 20, 21 are also provided in each case on both the short leg 12 and also on the long leg 13 of the main profile 300, 400 respectively on the inner sides facing toward one another in FIGS. 11 and 12, which entirely or partially delimit at least the following groove: respectively a fastening groove 20*b*, 21*b* open in the same direction on the side facing away from the transverse leg 14 for fixing a corresponding fastening means of the fitting part or the cover element.

The main profile 400 of FIG. 11*a*) is constructed substantially like the main profile of FIG. 2. FIG. 11 shows the main profile 400 from the opposite side as FIG. 2*c*, however (i.e., from below if the view of FIG. 2*c* is identified as the top view).

A removable preassembly web 22 is not provided according to FIG. 11. Instead, transverse webs 68, which connect the short leg 12 and the long leg 13 to one another, are provided on the main profile 400 of FIG. 11. Recesses 69 are respectively provided between the transverse webs 68. The transverse webs 68 are preferably formed in one piece with the short leg 12 and the long leg 13. The main extension direction of the transverse webs 68 is the transverse direction.

Because the main profile 400 is formed as an extruded profile, the recesses 69 are only stamped or cut out after the extrusion. Therefore, a transverse leg 66' continuous in the main extension direction initially connects the short leg 12 and the long leg 13 after the extrusion. Only then are the recesses 69 introduced and only the transverse webs 68 remain of the transverse leg.

The transverse web or webs 68 have an extension direction perpendicular to the direction Z and an extension in the direction Z, wherein Z is the main extension direction of the main profile 300, 400. The transverse webs 68 are spaced apart from one another in the main extension direction Z of the main profile 300, 400.

It is particularly advantageous if the recesses 69 have a relatively large surface area, and are preferably larger than the material area of the transverse webs 68. The larger the recesses 69 are, the better fittings, for example, may be installed.

The transverse webs 68 extend in the main extension direction Z of the main profile 400 and perpendicularly thereto in a connection direction, which is the direction in which the respective transverse web 68 connects the two long legs (the long leg and the short leg here) to one another. The thermal insulation properties of the main profile or of a window or a door, respectively, are advantageously improved in this region by the recesses 69.

However, it is particularly advantageous that fittings, for example, hinges or lock cylinders, may be integrated easily and thus advantageously into the main profile 400 through the at least one recess 69 or may be installed thereon, without the main profile 400 having to be machined before the installation of a fitting.

The recesses 69 preferably have an extension between 100 mm and 200 mm, particularly preferably between 125 mm and 175 mm, in the main extension direction Z.

The recesses 69 (and accordingly the transverse webs 66) preferably extend over the entire distance between the long leg 13 and the short leg 12. They extend here between the ends of the function contours 20, 21 of the long leg 13 and the short leg 12 facing toward one another. This is particularly preferable and facilitates the installation of fittings in a special manner. Alternatively, however, the recess 69 can also extend over only up to 75%, in particular up to 50% of the width of the transverse web 68.

The transverse webs 68 preferably have an extension of 15 mm to 55 mm, particularly preferably between 30 mm and 45 mm, in the main extension direction X.

These dimensions are preferably achieved at at least one or more of the recesses 69. The finished main profile 300, 400 may thus be further processed well, thus each may be miter cut for the frame or sash 2, 1, and fittings may thus be installed particularly well in the region of the recesses 69.

The above features, which have been explained for the main profile 400 of FIG. 11, are also implementable on the main profile 300 of the frame, without this being shown here.

The transverse leg 14 of the main profile 300, 400 of FIGS. 3 and 4 is formed as at least one separate insulating web 39 (FIG. 3*b*) or as a composite made of multiple insulating webs arranged almost together, which is/are connected in an interlocking and frictional manner to the short leg 12 and the long leg 13, preferably such that a composite shear-resistant perpendicular to the plane of FIG. 3*a* is formed. This is also the case in the main profile 400 of FIG. 12. In addition, however, an insulating web 70 made of plastic, optionally reinforced using metal transverse webs/bridges, is also formed between the short leg 12 and the long leg 13.

This insulating web 70 preferably connects the function contours 20, 21 of the short leg 12 and the long leg 13 to one another. It (and possibly the metal reinforcement(s) in its region) has/have recesses 71. The insulating web is thus reduced to transverse webs 72, between which the recesses 71 are formed. The recesses 71 and the transverse webs 72 are in turn preferably formed similarly with respect to the dimensions thereof to the recesses 69 of FIG. 11.

The above features which have been explained for the main profile 400 of FIG. 12 are also implementable on the main profile 300 of the frame, without this being shown here.

According to FIGS. 11 and 12, an "essentially U-shaped cross section" is again implemented, because the two legs extending perpendicularly to the (first) transverse leg 14—the short leg 12 and the long leg 13 here—are directly or indirectly connected to one another at the ends thereof facing away from the transverse leg 14 connecting them in the main extension direction Z (see also FIG. 2*c*) of the main profile only in sections (over less than half of the length or extension thereof in the main extension direction Z) via a further, second transverse leg, which is formed here in each case by the explained transverse webs having the recesses formed in between.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS door 1
sash 2
frame 3
corner connector 4
sash spars 5, 6 sash spar 7
planar element 8
frame spars 9, 10, 11
short leg 12
long leg 13
transverse leg 14
free end 15, 15*a*
glazing bead groove 16
glazing bead 17
seal groove 18
seal 19
function contours 20, 21
corner connector receptacle groove 20*a*, 21*a*
fastening groove 20*b*, 21*b*
receptacle groove 20*c*, 21*c*
receptacle groove 20*d*, 21*d*
preassembly web 22
transverse web 23, 24
parallel web 25, 26
groove 26, 27
corner connector grooves 28*a, b*
holding webs 29, 30
angled webs 31, 32
interlocking contours 33, 34
transverse webs 35, 36
hollow chambers 37, 38
insulating webs 39, 39*a*, 39*b*
webs 40,41
cover profile 42
catch feet 43, 44
cover legs 45
undercuts 46
plastic bridge 47
fire protection region 48
cover layer 49
lock assembly 50
profile clamps 51
main legs 51*a*
longitudinal legs 51*b*, 51*c*
angle 52
catch web 53
lock 54
striker plate 55
bolt 56
borehole 57
screw 58
carrier element 59
base leg 59*a*
longitudinal legs 59*b, c*
thickened areas 59*d, e*
screw borehole 60
securing clips 61, 62
catch edges 63, 64
cooling strip 65
seal 66
seal 67
transverse web 68
recesses 69
insulating web 70
recesses 71
transverse webs 72
main profile 300, 400
rabbet spaces F1, F2, F3
plane E1

The invention claimed is:

1. A frame spar for a frame or a sash spar for a sash, the frame or sash being part of a window, a door, or a façade element, the frame spar or sash spar comprising:

a main profile having a substantially U-shaped cross-section that is a single piece or comprised of multiple pieces, which, viewed in cross-section, has a short leg and a long leg, and a transverse leg formed between the short leg and long leg, wherein a free intermediate space, which is overlapped at least in sections by a cover element, a fitting part, or a cover element and a fitting part, is formed between ends of the short leg and the long leg facing away from the transverse leg, wherein the short leg of the main profile has a multifunction contour on an inner side of the short leg, the inner side of the short leg facing toward the long leg, wherein the multifunction contour of the short leg entirely or partially delimits at least a short leg fastening groove open in a same direction on a side facing away from the transverse leg for fixing a corresponding fastener of the fitting part or the cover element, wherein the long leg of the main profile has a multifunction contour on an inner side of the long leg, the inner side of the long leg facing toward the short leg, wherein the multifunction contour of the long leg entirely or partially delimits a long leg fastening groove open in the direction on the side facing away from the transverse leg for fixing a corresponding fastener of the fitting part or the cover element.

2. The frame spar and/or sash spar of claim 1, wherein the fastening groove of the short and long legs each have at least one catch for at least one locking fixing of a corresponding counter catch of the fitting part or the cover element.

3. The frame spar and/or sash spar of claim 2, wherein at least one cover profile is arranged between the short leg and the long leg as the cover element so that the main profile is closed in regions or continuously on an open side of the U shaped cross-section of the main profile facing away from the transverse leg of the main profile, wherein the cover profile is arranged in a non-shear-resistant manner on the main profile and the cover profile has a U-shaped cross-section.

4. The frame spar and/or sash spar of claim 3, wherein the cover profile has a counter catch interacting with a catch of the fastening grooves of the short and long legs such that the cover profile is displaceable in a main extension direction of the main profile in a locked state.

5. The frame spar and/or sash spar of claim 3, wherein the cover profile is formed in one piece or multiple pieces and consists of plastic or a fire protection material or of a combination of these two materials.

6. The frame spar and/or sash spar of claim 5, wherein the fire protection material of the cover profile is a material which foams in case of fire under effect of temperature.

7. The frame spar and/or sash spar of claim 3, wherein the cover profile has the U-shape and overlaps the free intermediate space between the short leg and the long leg like a bridge at ends thereof facing away from the transverse leg, and the cover profile has catch feet and a transverse web or a cover leg connecting the catch feet.

8. The frame spar and/or sash spar of claim 7, wherein the cover profile forms a U-shaped fire protection bridge.

9. The frame spar and/or sash spar of claim 8, wherein the cover leg is provided with a cover layer.

10. The frame spar and/or sash spar of claim 3, wherein the cover profile is inserted into the fastening grooves of the short and long legs perpendicularly to the transverse leg of the main profile and parallel to the short leg and the long leg.

11. The frame spar and/or sash spar of claim 3, further comprising:

one or more profile clamps, which are made of metal, have a U-shape comprising a main leg and two short longitudinal legs, wherein the one or more profile clamps are arranged between the short leg and the long leg, and wherein the one or more profile clamps are the fitting part, wherein the two short longitudinal legs of the one or more profile clamps form catch sections, each of which are the counter catch for engaging in a locking manner in one of the fastening grooves of the long and short legs of the main profile and which interact with the catch of the fastening grooves of the short and long legs such that the profile clamps are fixed in a shear-resistant manner in the fastening grooves of the short and long legs.

12. The frame spar and/or sash spar of claim 11, wherein the catch sections of the profile clamps are formed sharp edged, such that the catch sections cut into material of the fastening grooves of the short and long legs, and therefore the profile clamps are fixed securely from displacement in the fastening grooves of the short and long legs.

13. The frame spar and/or sash spar of claim 11, wherein one or more of the profile clamps are arranged below the and/or inwardly from the cover profile on the main profile.

14. The frame spar and/or sash spar of claim 11, wherein the profile clamps are 20 to 40 mm long in a main extension direction of the main profile, and are placed spaced apart from one another in the main extension direction at an interval of 400 to 600 mm.

15. The frame spar and/or sash spar of claim 11, wherein the profile clamps consist of sheet steel.

16. The frame spar and/or sash spar of claim 11, wherein one of the profile clamps is attached on the main profile of the sash spar where a lock assembly is attached vertically above the profile clamp.

17. The frame spar and/or sash spar of claim 1, wherein the multifunction contours of the short and long leg each have a multifunction contour transverse leg protruding perpendicularly from the short leg and the long leg, respectively, and also at least one angled web.

18. The frame spar and/or sash spar of claim 17, wherein the transverse leg of the main profile is entirely or partially formed as at least one separate insulating web or multiple insulating webs, which is/are connected in an interlocked and frictional manner to the short leg and the long leg to form a shear-resistant composite.

19. The frame spar and/or sash spar of claim 18, wherein the short leg, the multifunction contour transverse leg of the short leg, and one parallel web delimit and partially form one of the fastening grooves, and the long leg, the multifunction contour transverse leg of the long leg, and another parallel web delimit and partially form another one of the fastening grooves.

20. The frame spar and/or sash spar of claim 19, wherein the fastening groove of the short leg is formed by the one parallel web and one angled web, wherein the one parallel web and the one angled web are formed on opposite sides of the multifunction contour of the short leg and the one parallel web and the one angled web face each other, wherein the fastening groove of the long leg is formed by the another parallel web and another angled web, wherein the another parallel web and the another angled web are formed on opposite sides of the multifunction contour of the long leg and the another parallel web and the another angled web face each other, and wherein the fastening grooves of the short and long legs are open toward a rabbet space between the frame and the sash.

21. The frame spar and/or sash spar of claim 1, wherein the multifunction contours of the short and long legs each entirely or partially delimit one of two corner connector receptacle grooves for accommodating a corner connector, wherein inner edges of corner connectors are inserted into each of the corner connector receptacle grooves, and wherein the two corner connector receptacle grooves are dimensioned identically such that structurally equivalent corner connectors are usable therein.

22. The frame spar and/or sash spar of claim 1, wherein the multifunction contours of the short and long legs each entirely or partially delimit a receptacle groove for accommodating a fire protection strip.

23. The frame spar and/or sash spar of claim 1, wherein the multifunction contours of the short and long legs each entirely or partially delimit a receptacle groove for accommodating a preassembly web.

24. The frame spar and/or sash spar of claim 23, wherein the receptacle grooves on the short leg or on the long leg, respectively, accommodate at least one preassembly web, wherein the at least one preassembly web is arranged between the receptacle grooves and connects the receptacle grooves like a bridge, and wherein the at least one preassembly web is guided so the at least one preassembly web is displaceable by sliding in the receptacle grooves, such that the at least one preassembly web is removable after completion of a frame assembly and after cutting of miter cuts.

25. The frame spar and/or sash spar of claim 23, wherein the receptacle grooves are undercut grooves, which are open on sides facing toward one another—in a direction parallel to the transverse leg of the main profile.

26. The frame spar and/or sash spar of claim 23, wherein the preassembly web has a middle web and interlocking contours, using which the preassembly web is insertable into the receptacle grooves and displaceable in the receptacle grooves, at both ends of the middle web, wherein the interlocking contours are designed corresponding to a cross section of the receptacle grooves and therefore the interlocking contours engage with little play in the receptacle grooves, such that the preassembly web is displaceable in the receptacle grooves.

27. A window, door, or façade element comprising:

a frame made of frame spars and a sash made of sash spars, each of which comprises a main profile having a substantially U-shaped cross section that is a single piece or comprised of multiple pieces, which, viewed in cross-section, has a short leg and a long leg, and a transverse leg formed between the short leg and long leg, wherein a free intermediate space, which is overlapped at least in sections by a cover element, a fitting part, or a cover element and a fitting part, is formed between ends of the short leg and the long leg facing away from the transverse leg, wherein the short leg of the main profile has a multifunction contour on an inner side of the short leg, the inner side of the short leg facing toward the long leg, wherein the multifunction contour of the short leg entirely or partially delimit at least a short leg fastening groove open in a same direction on a side facing away from the transverse leg for fixing a corresponding fastener of the fitting part or the cover element, wherein the long leg of the main profile has a multifunction contour on an inner side of the long leg, the inner side of the long leg facing toward the short leg, wherein the multifunction contour of the long leg entirely or partially delimits a long leg fastening groove open in the direction on the side facing away from the transverse leg for fixing a corresponding fastener of the fitting part or the cover element, wherein the frame spars and the sash spars are formed structurally equivalent except for a longitudinal web for covering a planar element on the sash spars.

* * * * *